US011408707B2

(12) United States Patent
Murphy, II et al.

(10) Patent No.: US 11,408,707 B2
(45) Date of Patent: Aug. 9, 2022

(54) FIREARM ADAPTER WITH REMOVABLE GRIP ASSEMBLY

(71) Applicants: William Lewis Murphy, II, Orlando, FL (US); Robert Vail Harvey, Orlando, FL (US)

(72) Inventors: William Lewis Murphy, II, Orlando, FL (US); Robert Vail Harvey, Orlando, FL (US)

(73) Assignee: Gun Guardian LLC, Orlando, FL (US)

( * ) Notice: Subject to any disclaimer, the term of this patent is extended or adjusted under 35 U.S.C. 154(b) by 0 days.

(21) Appl. No.: 17/144,851

(22) Filed: Jan. 8, 2021

(65) Prior Publication Data

US 2021/0222994 A1 Jul. 22, 2021

Related U.S. Application Data

(63) Continuation-in-part of application No. 16/805,459, filed on Feb. 28, 2020, now Pat. No. 10,928,150.

(60) Provisional application No. 62/963,945, filed on Jan. 21, 2020.

(51) Int. Cl.

| | |
|---|---|
| ***F41C 23/10*** | (2006.01) |
| ***F41C 23/16*** | (2006.01) |
| *F41A 11/04* | (2006.01) |

(52) U.S. Cl.

CPC ..... *F41C 23/10* (2013.01); *F41C 23/16* (2013.01); *F41A 11/04* (2013.01)

(58) Field of Classification Search

CPC ..... F41C 23/10; F41C 23/16; F41C 23/22; F41A 11/04

See application file for complete search history.

(56) References Cited

U.S. PATENT DOCUMENTS

| | | | |
|---|---|---|---|
| 35,456 | A | 6/1862 | Leverich |
| 955,237 | A | 4/1910 | Westcott et al. |
| 1,569,553 | A | 1/1926 | Lewis et al. |
| 1,686,482 | A | 10/1928 | Windle |
| 1,695,071 | A | 12/1928 | Mariand |
| 1,887,308 | A | 11/1932 | Leroy |
| 2,080,202 | A | 5/1937 | Drake |
| 2,115,041 | A | 4/1938 | Alejandro |
| 2,590,516 | A | 3/1952 | Von |
| 2,932,334 | A | 4/1960 | Steen |
| 3,222,809 | A | 12/1965 | Bryan |

(Continued)

FOREIGN PATENT DOCUMENTS

| | | | | |
|---|---|---|---|---|
| CA | 2930014 | A1 * | 12/2016 | ..... F41A 9/66 |
| DE | 102006005117 | A1 | 8/2007 | |
| EP | 1058081 | B1 | 1/2006 | |

*Primary Examiner* — Jonathan C Weber

(74) *Attorney, Agent, or Firm* — Jason T. Daniel, Esq.; Daniel Law Offices, P.A.

(57) ABSTRACT

A firearm grip assembly includes a firearm adapter having functionality for engaging the receiver of a firearm. An elongated handgrip body having an opening along the top end slidingly receives the bottom end of the adapter. The latching mechanism is positioned within the adapter and includes a resilient member having a pair of buttons extending outward therefrom. The buttons are positioned through a first set of openings located on the adapter body and are selectively positioned within a second pair of openings on the handgrip body when the adapter is positioned within the handgrip body.

20 Claims, 8 Drawing Sheets

(56) References Cited

U.S. PATENT DOCUMENTS 3,224,587 A 12/1965 Schmidt
3,392,471 A 7/1968 Foote
4,422,254 A 12/1983 McQueen
4,754,498 A 7/1988 Stinemates
4,798,018 A * 1/1989 Johansson ..... F41A 17/38 42/7
4,858,361 A 8/1989 White
4,860,479 A 8/1989 Easter
5,012,605 A 5/1991 Nishioka
5,024,017 A 6/1991 Nishioka
5,075,994 A 12/1991 Nishioka
5,138,786 A 8/1992 Fischer
5,229,532 A 7/1993 Brooks
5,419,068 A 5/1995 Pages et al.
5,638,627 A 6/1997 Klein et al.
5,992,075 A 11/1999 Ockenfuss et al.
6,141,896 A 11/2000 Oberst
6,154,995 A 12/2000 Lenoir et al.
6,164,004 A 12/2000 Essary
6,206,261 B1 3/2001 McCrary
6,240,669 B1 6/2001 Spaniel et al.
6,253,480 B1 7/2001 Florez
6,389,726 B1 5/2002 Bentley
6,389,729 B2 * 5/2002 Rauch ..... F41C 23/10 42/71.01
6,405,861 B1 6/2002 Siler et al.
6,459,064 B1 10/2002 Trubert
6,578,307 B2 6/2003 Troyer
6,640,480 B2 * 11/2003 Williams ..... F41A 29/00 42/95
6,874,266 B1 * 4/2005 Kong ..... F41C 23/22 42/7
7,030,729 B2 4/2006 Albanesi et al.
7,194,836 B1 3/2007 Urban
7,559,166 B2 * 7/2009 Bubits ..... F41A 17/38 42/7
8,522,582 B2 9/2013 Keightley
8,561,334 B2 * 10/2013 Metzger ..... F41A 17/38 42/7
8,713,836 B1 5/2014 Haq
8,807,007 B2 8/2014 Alicea
8,931,393 B1 1/2015 Vincent et al.
9,062,923 B1 * 6/2015 Thorup ..... F41A 11/00
9,097,479 B1 8/2015 Barido et al.
9,121,655 B1 9/2015 Murphy et al.
9,127,905 B2 * 9/2015 Schreckenstein ..... F41C 23/12
9,404,699 B1 8/2016 Barido et al.
9,459,064 B1 10/2016 Xu
9,658,017 B2 5/2017 Alicea
9,733,033 B1 8/2017 Barido et al.
9,746,266 B1 8/2017 Barido et al.
9,841,250 B1 12/2017 Mirza
10,184,737 B2 * 1/2019 Roberts ..... F41C 23/06
10,247,520 B2 * 4/2019 Manly ..... F16B 21/186
10,697,730 B2 * 6/2020 Brown ..... F41C 23/10
10,767,943 B2 * 9/2020 Roberts ..... F41C 23/06
11,035,647 B2 * 6/2021 Brown ..... F41C 27/16
2002/0116856 A1 8/2002 Troyer
2003/0136044 A1 * 7/2003 Williams ..... F41C 23/22 42/95
2007/0169390 A1 * 7/2007 Bubits ..... F41A 17/38 42/7
2010/0154271 A1 6/2010 Victor et al.
2011/0047849 A1 3/2011 Brenner
2012/0137559 A1 6/2012 Burns
2014/0259850 A1 * 9/2014 Schreckenstein ..... F41C 23/12 42/75.03
2015/0000171 A1 * 1/2015 Roberts ..... F41A 3/66 42/75.03
2015/0204628 A1 7/2015 Würkner
2016/0084601 A1 3/2016 Alicea
2016/0097614 A1 * 4/2016 Manly ..... F16B 21/186 42/90
2016/0370138 A1 * 12/2016 Zamm ..... F41A 9/66
2017/0219305 A1 * 8/2017 Roberts ..... F41C 23/06
2020/0232754 A1 * 7/2020 Brown ..... F41C 23/16

* cited by examiner

FIREARM ADAPTER WITH REMOVABLE GRIP ASSEMBLY

CROSS-REFERENCE TO RELATED APPLICATIONS

This application claims the benefit of U.S. Applications 62/963,945 filed, on Jan. 21, 2020, and is a continuation in part to U.S. application Ser. No. 16/805,459, filed on Feb. 28, 2020, which ultimately claims the benefit of U.S. Application 62/570,245, filed on Oct. 10, 2017, the contents of each of which are incorporated herein by reference.

TECHNICAL FIELD

The present invention relates generally to firearm parts and accessories, and more particularly to a firearm grip that is removably connected to a firearm receiver.

BACKGROUND

The statements in this section merely provide background information related to the present disclosure and may not constitute prior art.

Many firearm owners routinely modify their weapons to suit a particular interest or a desired look. With regard to handguns and rifles, it can be desirable to change out the pistol grip (i.e., "grip") with an aftermarket product so as to include a different shape, size, color, construction material, and/or gripping texture, depending on the conditions under which the firearm is to be used.

For this reason, there are no shortages of available aftermarket firearm grips which can be mated to existing firearm receivers. With particular regard to assault-style rifles, such as the AR-15, for example, the grip is physically mounted to the bottom of the lower receiver by a selector spring and bolt at a location adjacent to the trigger assembly. In this regard, traditional replacement grips have required the use of specialized tools and knowledge to remove one grip and replace it with another.

Although this procedure goes well for experienced firearm users, it does take several minutes to effectuate a handgrip swap. Moreover, due to the small parts and tools involved, it is not recommended to perform this action at a range or outdoor area as it is possible to lose the spring, bolt or tool, thus rendering the firearm unusable. Additionally, many less experienced individuals are hesitant to physically disassemble and reassemble a firearm grip assembly. As a result, these individuals utilize the firearm with a grip that is less than optimal for their given circumstances.

Accordingly, it would be beneficial to provide a firearm adapter that can be mated with a firearm in order to quickly and easily receive, engage and swap any number of different types of grips without requiring specialized knowledge or tools, so as to overcome the drawbacks described above.

SUMMARY OF THE INVENTION

The present invention is directed to a firearm grip assembly. One embodiment of the present invention can include a firearm adapter having functionality for engaging the receiver of a firearm. An elongated handgrip body having an opening along the top end can be in communication with the adapter, and a latching mechanism can secure the handgrip body and adapter together.

In one embodiment, the handgrip body and the adapter are slidingly engaged whereby the bottom end of the adapter is positionable through the open top end of the handgrip body.

In one embodiment, the latching mechanism includes a resilient member having a pair of buttons extending outward therefrom. The buttons can be positioned through a first set of openings on the adapter body and can be selectively positioned within a second pair of openings on the handgrip body when the adapter is positioned within the handgrip body.

The bottom end of the adapter can be oriented at different angles relative to the top end of the adapter body to permit placement of the handgrip at different angles relative to the receiver to which the adapter is secured.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
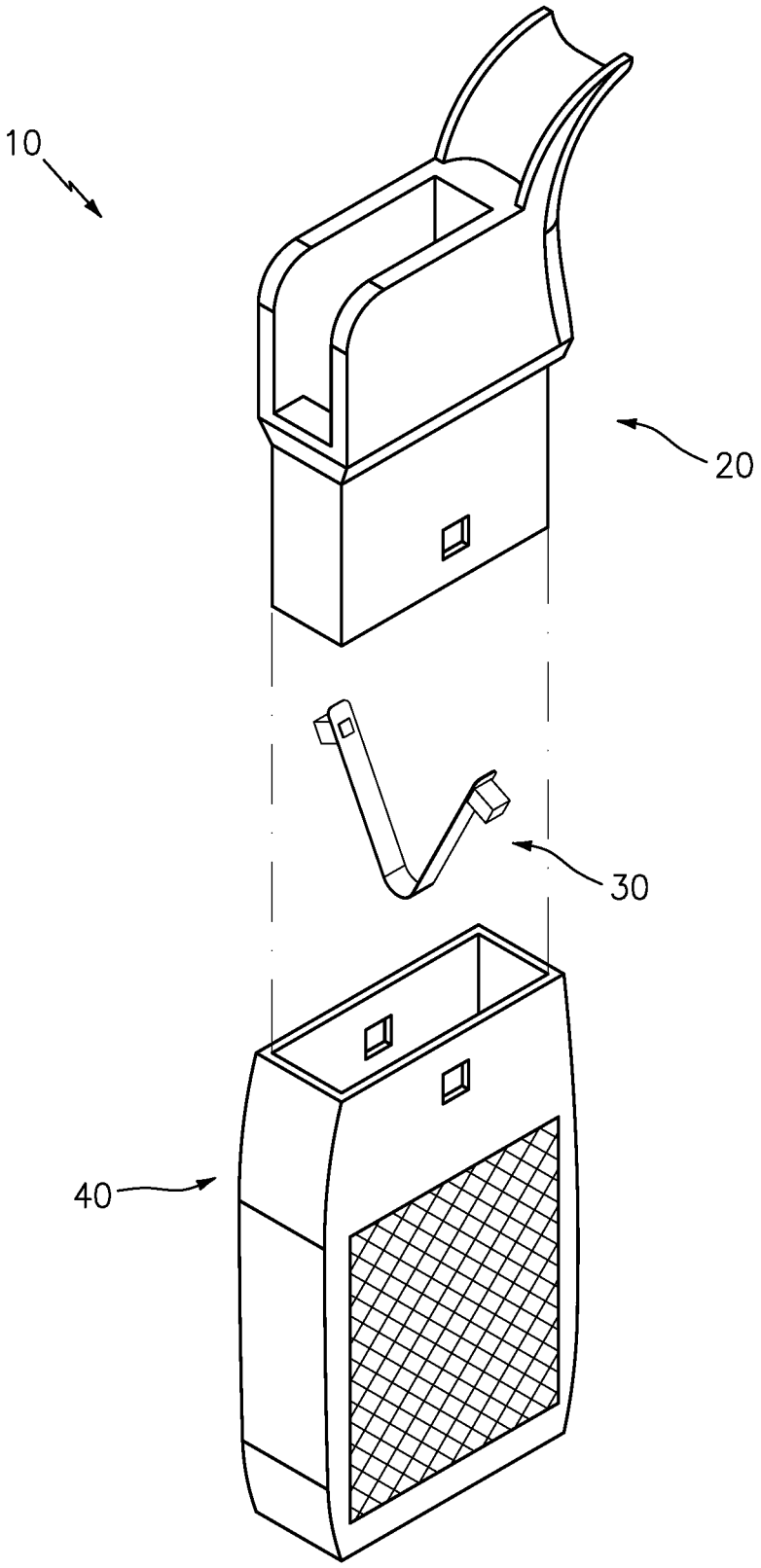
FIG. 1 is an exploded parts view of the firearm grip assembly, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Although illustrated with regard to positioning a grip on an assault-style rifle, the inventive concepts are not so limiting. To this end, the inventive concepts can be used with any type of firearm such as a handgun, rifle, shotgun, crossbow, etc., and can be used to removably position any number of different devices anywhere along the weapon.

As described herein, the term "removably secured" and derivatives thereof shall be used to describe a situation wherein two or more objects are joined together in a non-permanent manner so as to allow the same objects to be repeatedly joined and separated. This can be accomplished through the use of the below described latching mechanism and/or through the use of any number of connectors such as various magnets, or compression fittings such as locking pins, male and female fittings, clamps, and tethers, for example.

FIGS. 1-5B illustrate one embodiment of a firearm adapter with removable grip assembly 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As will be described below, the assembly 10 can function as a replacement to the manufacturer-supplied handgrip of any number of different types of firearms. The assembly includes an adapter having certain dimensions and connectors at locations that are complementary to those found on the original handgrip, so as to use the manufacturer supplied hardware (e.g., springs, bolts, etc.). Once secured onto the receiver, the adapter can removably engage any number of different hand grips in the manner hereinafter described, so as to allow a user to quickly and easily swap grips at any time.

To this end, the inventive concepts can be provided with the new construction of a firearm and/or firearm receiver, as an aftermarket product, and/or as a kit having one or more adapters and one or more different handgrips.

As shown at FIG. 1, the assembly 10 can include, essentially, a firearm adapter 20, a removable handgrip 40, and a resilient latching mechanism 30.

Figure 2:
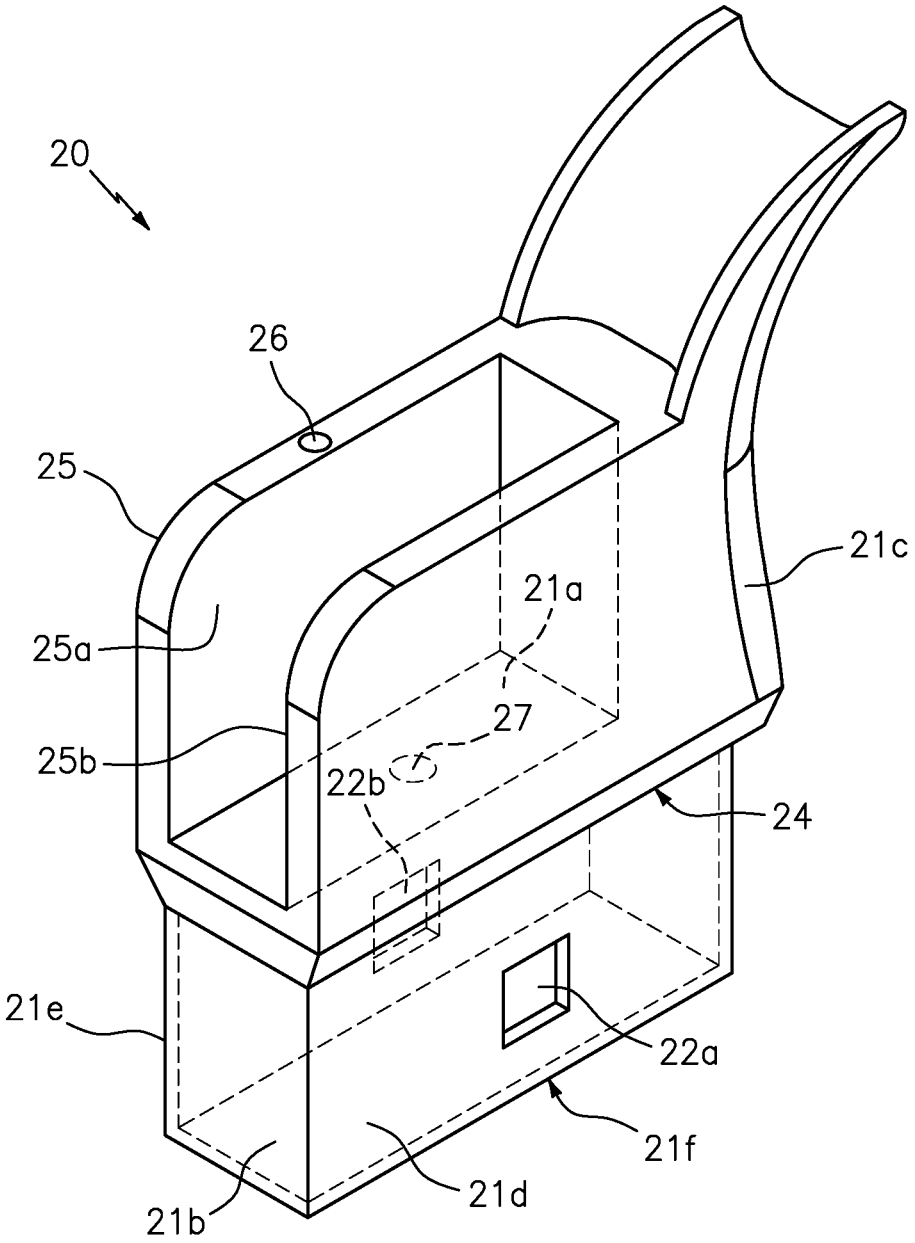
FIG. 2 is a perspective view of the firearm adapter body of the firearm grip assembly, in accordance with one embodiment of the invention.

FIG. 2 illustrates one embodiment of the firearm adapter 20. As shown, the adapter can include a main body having a top end 21*a*, a front end 21*b*, a back end 21*c*, side walls 21*d*-21*e* and an open bottom end 21*f* that define a hollow interior space. A protruding lip 24 can be positioned about the middle portion of the main body, and a pair of openings 22*a* and 22*b* can be positioned within the side walls 21*d* and 21*e*, respectively, for receiving the latching mechanism 30.

A raised channel 25 can extend upward from the top end of the body section. The channel can include sidewalls 25*a* and 25*b* that are separated by a distance D. The channel functioning to receive a portion of the bottom end of a firearm receiver between the sidewalls, so as to secure the adapter to the receiver at a location adjacent to the trigger assembly. To this end, the adapter 20 can include any number of different apertures that are positioned along the channel and/or body sections at any number of different locations so as to be positioned complementary to those of a factory-supplied handgrip in order to allow the adapter to be secured to the receiver using the same mounting hardware.

For example, when the adapter 20 is designed for use with an AR-15 rifle, such as the adapter illustrated in FIG. 2, for example, the separation distance D can be approximately 1 cm, a first aperture 26 can be positioned along the top end of the channel sidewall 25*a* for receiving a selector spring, and a second aperture 27 can be positioned through the top end of the body section 21*a* between the walls of the channel 25*a* and 25*b*, for receiving a bolt that engages a threaded opening on the receiver. Of course, any number of other separation distances, and/or apertures can be provided at any number of other locations along the adapter for engaging the receiver of any type of firearm.

In the illustrated embodiment, the bottom end of the adapter (e.g., the portions of sidewalls 21*b*, 21*c*, 21*d* and 21*d* beneath the lip 24), is oriented in line with the top end of the adapter, so as to receive the below described grip 40 vertically. Such a feature functioning to position the grip in a generally perpendicular orientation to the major axis of the firearm receiver (See FIG. 5B).

Of course, other embodiments are contemplated wherein the bottom end of the adapter is oriented diagonally from the top end of the adapter. Such a feature functioning to receive and position the grip diagonally relative to the major axis of the receiver. This diagonal angle can be any number of different angles so as to provide users with multiple options for orienting their chosen grip along the firearm.

Figure 3A:
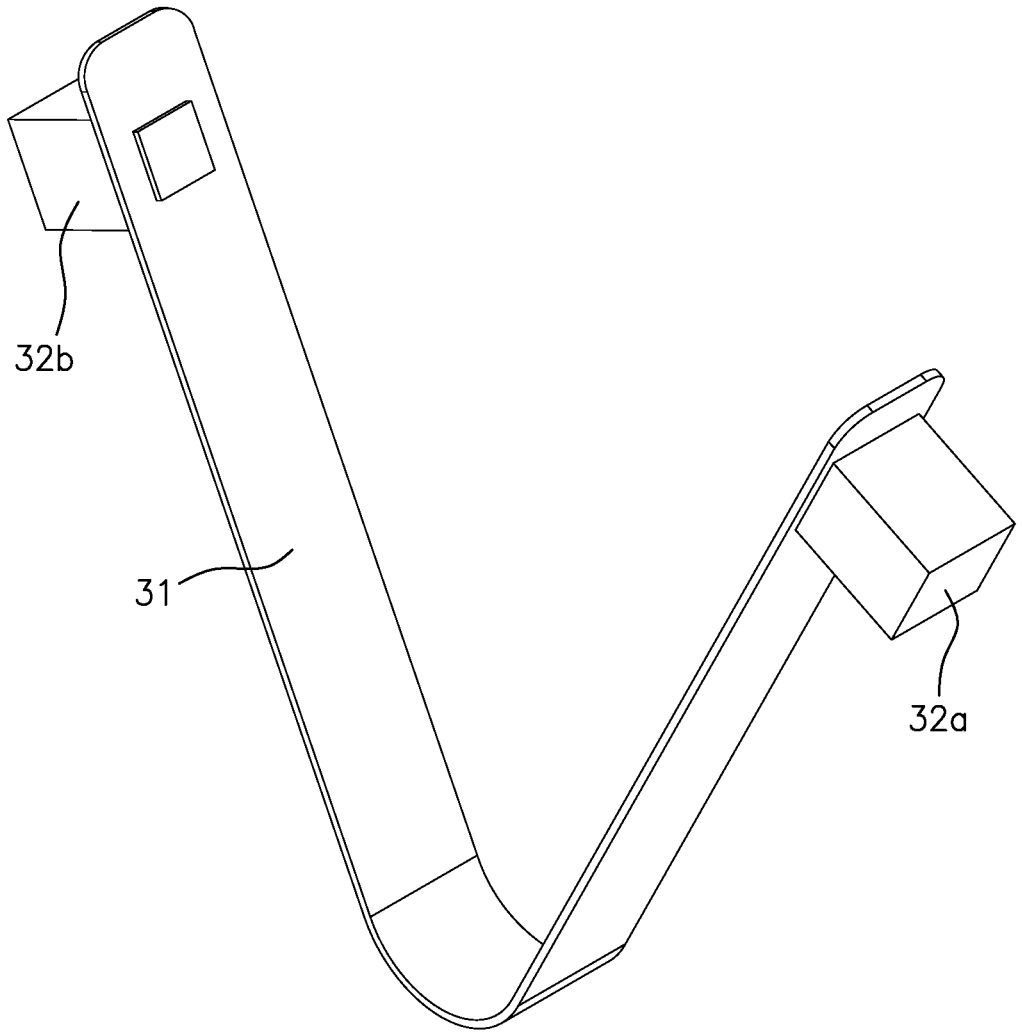
FIG. 3A is a perspective view of a latching mechanism of the grip assembly, in accordance with one embodiment of the invention.
Figure 3B:
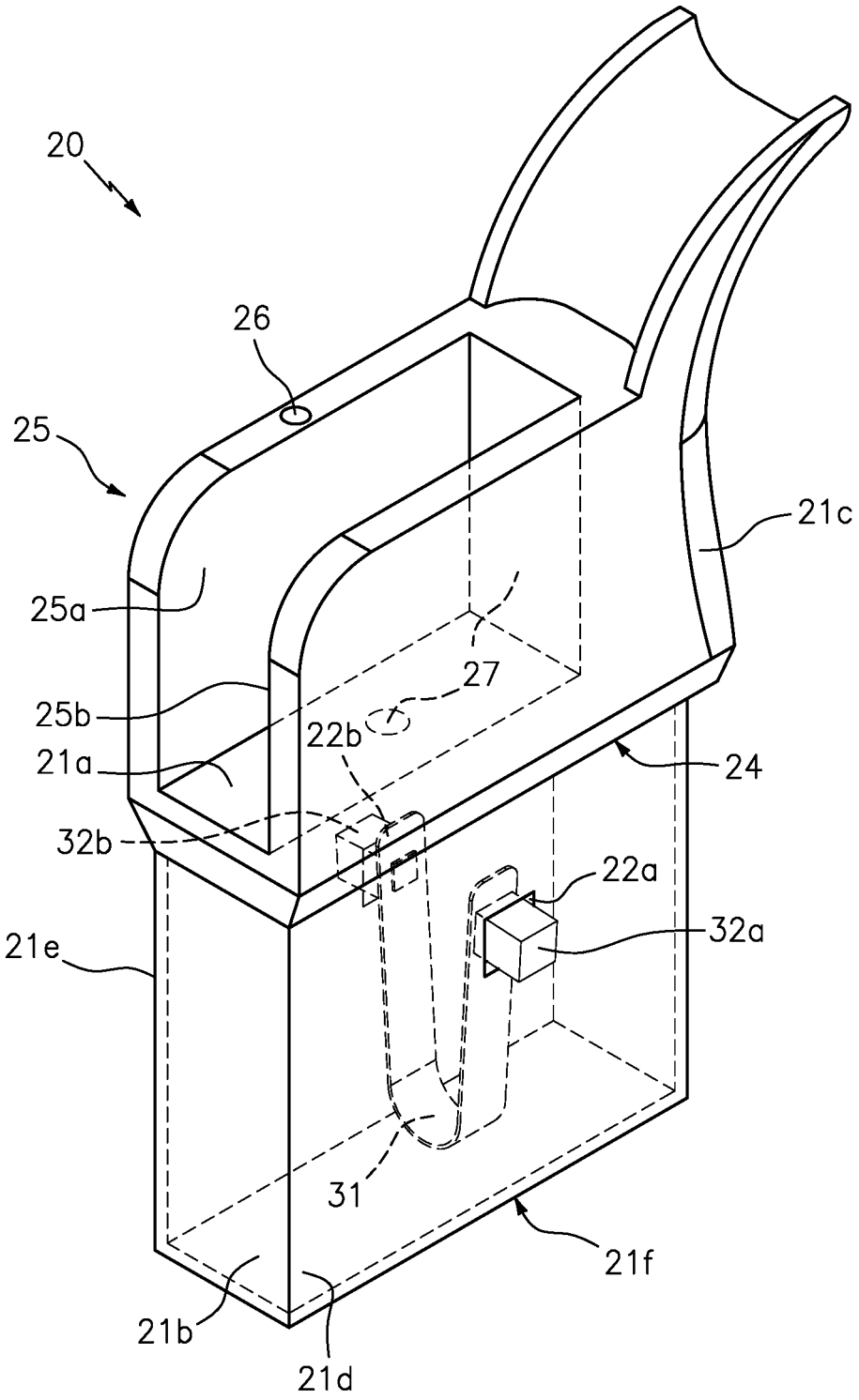
FIG. 3B is a perspective view of the adapter and latching mechanism of the grip assembly, in accordance with one embodiment of the invention.

FIG. 3A illustrates one embodiment of a latching mechanism 30 for securing a grip 40 to the adapter 20. In the illustrated embodiment the latching mechanism can comprise a metallic button spring clip having a generally Y-shaped resilient body section 31 with a pair of buttons 32*a* and 32*b* along both ends. As shown at FIG. 3B, the latching mechanism can be positioned within the interior space of the adapter such that the buttons 32*a* and 32*b* extend through the openings 22*a* and 22*b*, respectively.

Figure 3C:
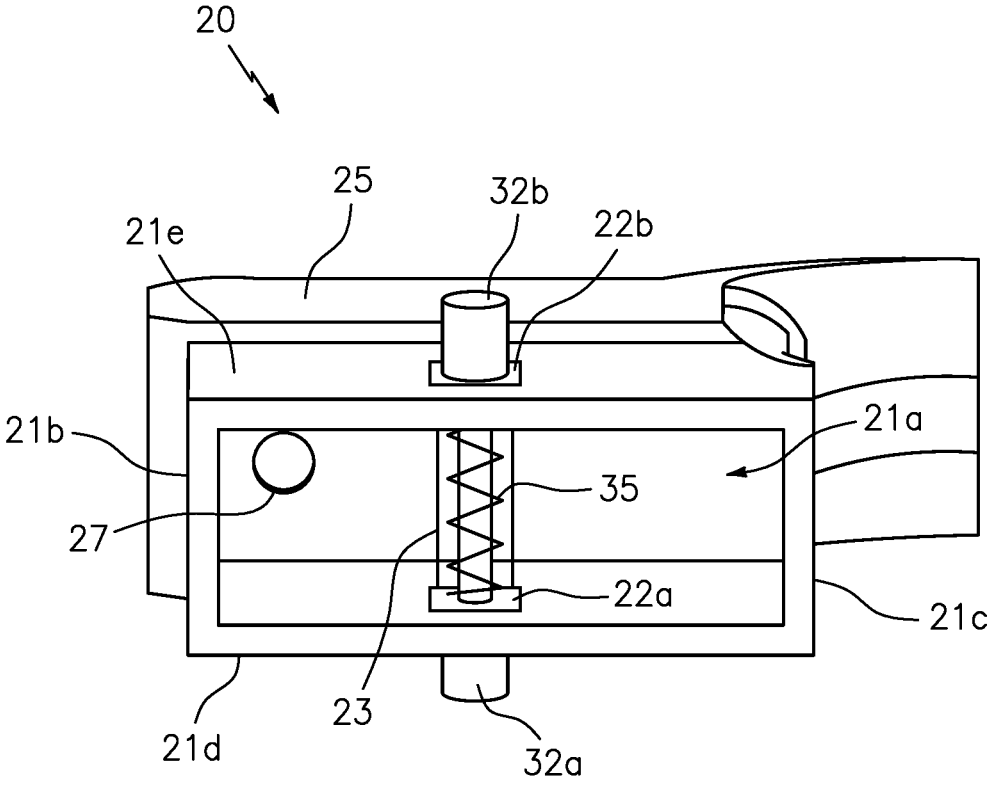
FIG. 3C is bottom view of the adapter and latching mechanism of the grip assembly, in accordance with one embodiment of the invention.
Figure 4:
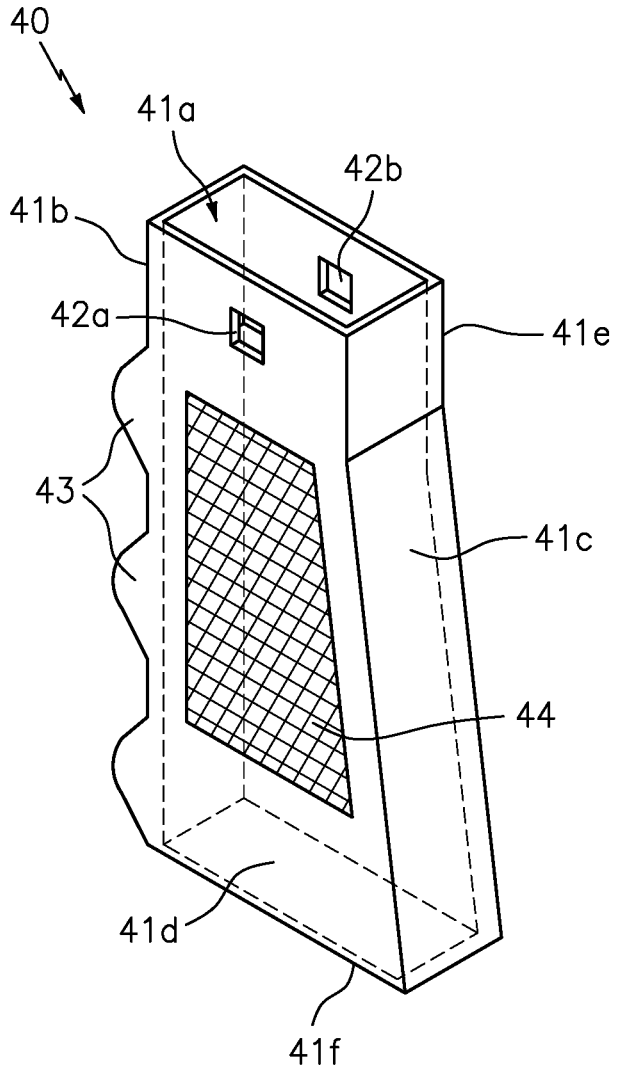
FIG. 4 is a perspective view of the firearm grip of the grip assembly, in accordance with one embodiment of the invention.

Although described above with regard to a button spring clip, many other components may be utilized. For example, FIG. 3C illustrates one embodiment of a latching mechanism wherein the Y-shaped body section is replaced with a generally planar resilient member 35 such as a micro-piston or compression spring, for example, that is in communication with the buttons 32*a* and 32*b* along each end. In the illustrated embodiment, the resilient member 35 can be biased to impart a constant pushing force onto the buttons 32*a* and 32*b* and can be positioned along a shelf 23 that extends between the sidewalls 21*d* and 21*e*. The shelf functioning to prevent shifting of the latching mechanism when in use.

FIG. 4A illustrates one embodiment of a handgrip 40 of the assembly. In the illustrated embodiment, the grip can comprise a pistol-style grip having an elongated body with an open top end 41*a*, a front end 41*b*, a back end 41*c*, side walls 41*d* and 41*e*, and a bottom end 41*f* that define a hollow interior space. In one embodiment, a pair of openings 42*a* and 42*b* can be positioned within sidewalls 41*d* and 41*e*, respectively.

In the preferred embodiment, the opening defined by the top end 41 can include a shape and a size that is complementary to the shape and the size of the bottom end of the adapter (e.g., the portions of sidewalls 21*b*, 21*c*, 21*d* and 21*d* beneath the lip 24), so as to receive the same. Additionally, openings 42*a* and 42*b* can be positioned at locations complementary to openings 22*a* and 22*b*, respectively, so as to be in line with each other when the bottom end of the adapter is positioned within the grip.

As described herein, the grip 40 can be constructed from any number of different materials and can include any number of different shapes and sizes. Moreover, the exterior facing portions of the handgrip can include any number of gripping elements such as various finger ridges 43 and/or texturing 44, to aid in a user's ability to firmly grasp the grip body. Although not specifically illustrated, the bottom end 41*f* of the grip can be solid or can include an opening and an optional door for selectively closing the bottom opening.

Figure 5A:
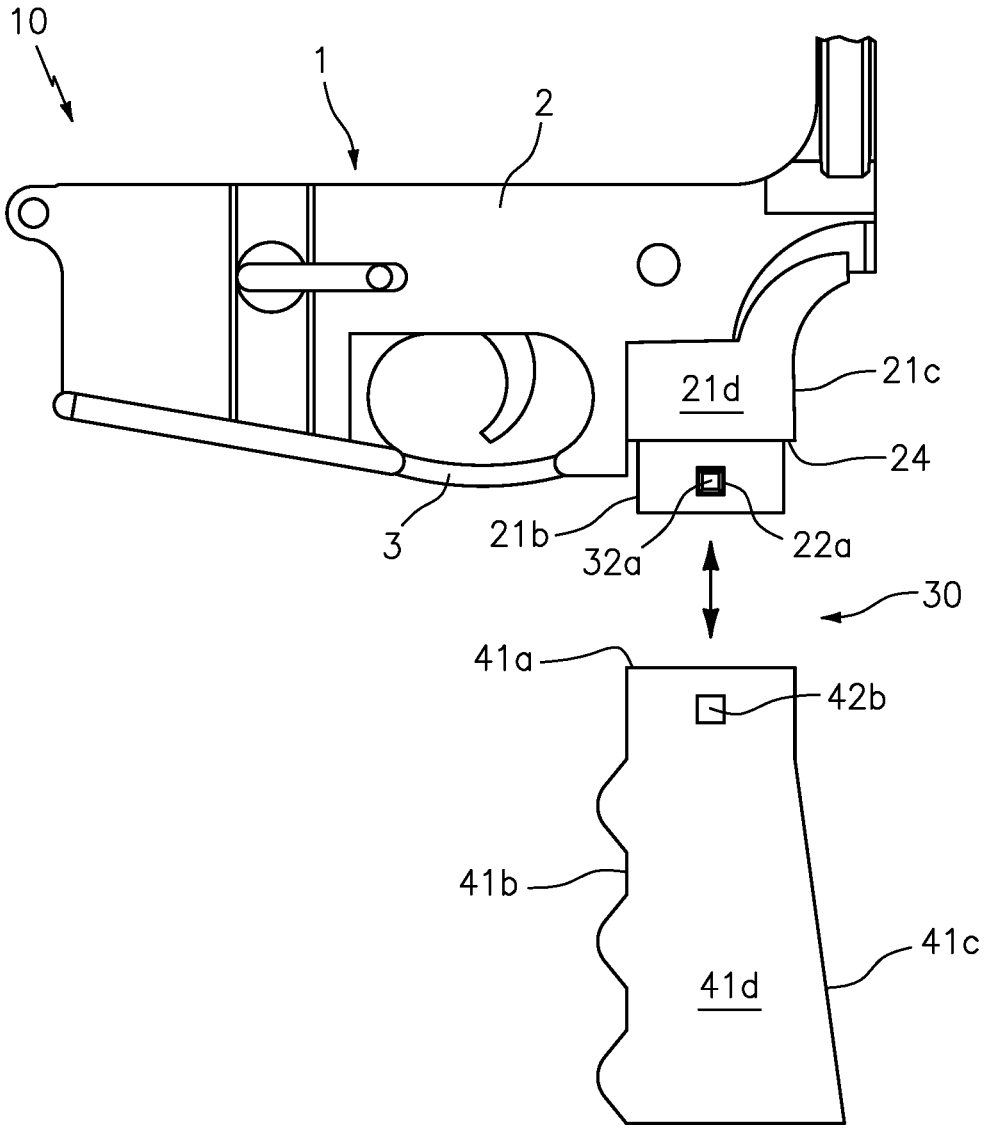
FIG. 5A is a side view of the firearm grip assembly in operation, in accordance with one embodiment of the invention.
Figure 5B:
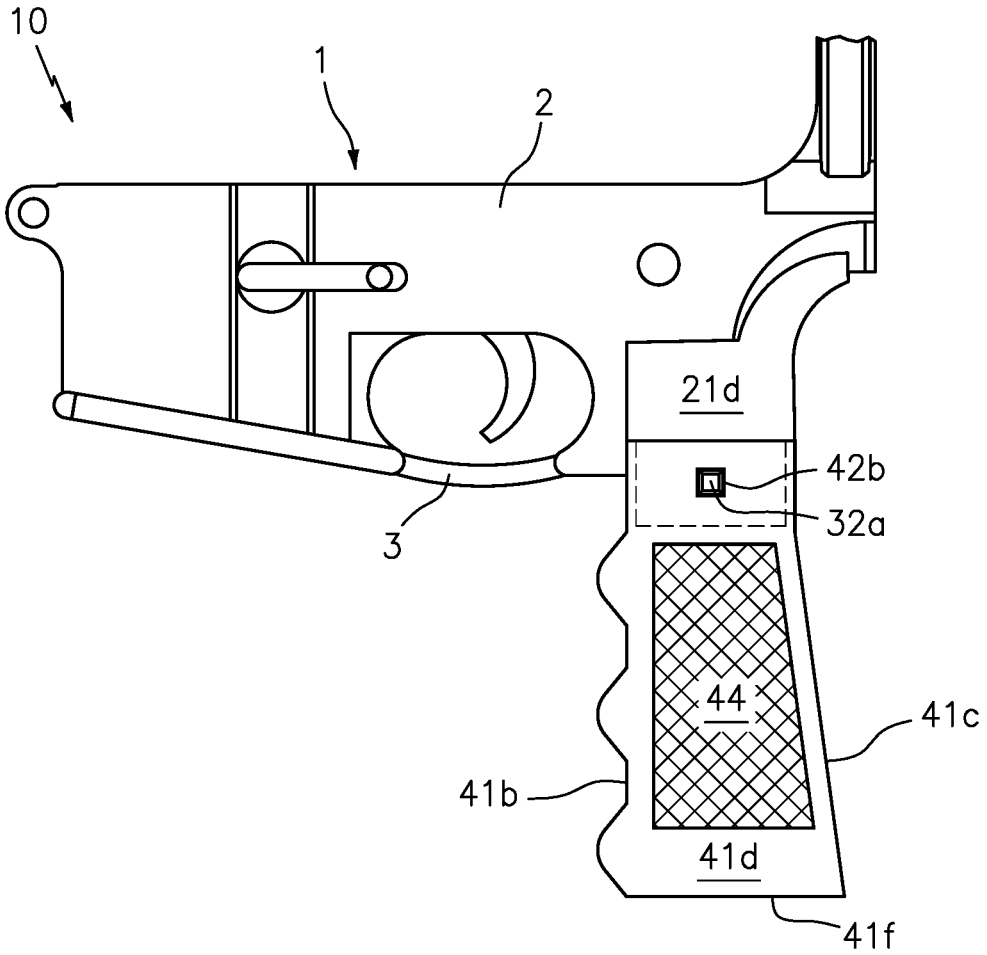
FIG. 5B is another side view of the firearm grip assembly in operation, in accordance with one embodiment of the invention.

FIGS. 5A and 5B illustrate one embodiment of the adapter and grip assembly 10 in operation with a firearm 1. As shown, the channel portion of the adapter 20 can engage the bottom of the firearm receiver 2 and can be secured thereto by the manufacturer supplied grip hardware, or with replacement hardware included with the assembly.

When so positioned, the adapter 20 will be positioned adjacent to the trigger assembly 3 as shown. Next, a user can insert the bottom of the adapter through the open top end of the grip 40. As the grip is slid over the adapter body, the buttons 32*a* and 32*b* that extending outward from the adapter walls 21*d* and 21*e* will make contact with the inside portions of the grip walls 41*d* and 41*e* until the top end 41*a* of the grip makes contact with the lip 24.

As shown at FIG. 5B, at this time, buttons 32*a* and 32*b* will be aligned with openings 42*a* and 42*b*, respectively, and will extend outward therefrom in order to lock the grip in place, thus preventing the grip and adapter from being unintentionally separated. Finally, when the user wishes to replace the grip with another, the buttons can be pressed inward, thereby allowing the first grip to be removed, and the above noted process can be repeated with the different grip.

In the preferred embodiment, the buttons 32*a* and 32*b* can be positioned so as to be flush with the outside surface of the grip when positioned within apertures 42*a* and 42*b*, respectively. Such a feature ensuring the buttons cannot be accidentally engaged or otherwise felt by a user when grasping the grip.

Accordingly, the above described adapter and grip assembly allows a user to quickly and easily swap the handgrip of a firearm through the press of a button, thus eliminating the need for specialized tools and hardware.

Although described with regard to two buttons that are placed on the sides of the components, this is for illustrated purposes only. To this end, other embodiments are contemplated where a single button is utilized and/or wherein the button(s) is/are positioned at other locations. Moreover, although described with regard to a vertical alignment and securement of the components, other embodiments are contemplated wherein the components can be secured horizontally or diagonally and can include securement components for facilitating the same.

Additionally, although described for use with a handgrip that is secured along the receiver, other embodiments are also contemplated. To this end, variants on the inventive concepts include the ability to secure the adapter 20 to other locations along a firearm such as the barrel rail system (e.g., KEYMOD, M-LOK, and PICATINNY), for example. Such a feature allowing a forward handgrip to be positioned onto the weapon. In such an embodiment, the handgrip can be augmented with additional functionality such as a flashlight, laser sight, and/or optical scope, for example, so as to impart the inventive functionality of a push button connection for accessory items onto the firearm rail system.

As described herein, one or more elements of the assembly components can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A firearm grip assembly, comprising:

an adapter body having a top end, a bottom end, a front end, a back end, and a pair of sides;

an elongated handgrip body having a top end, an opening along the top end, a bottom end, a front end, a back end, a pair of sides, and a hollow interior space; and a latching mechanism that is positioned within the adapter body, wherein the top end of the adapter body is configured to engage a firearm receiver, and the bottom end of the adapter is configured to be positioned within the opening on the top end of the handgrip body, and wherein the latching mechanism is configured to removably secure the handgrip body and the adapter body together.

2. The assembly of claim 1, wherein the adapter body includes a channel along the top end, said channel functioning to engage a bottom portion of a firearm receiver.

3. The assembly of claim 2, further comprising:

one or more apertures that are positioned along the adapter body, each of the one or more apertures being positioned and configured to receive mounting hardware for securing the adapter onto the firearm receiver.

4. The assembly of claim 1, further comprising:

a first pair of openings that are positioned along the pair of sides of the adapter body; and a second pair of openings that are positioned along the pair of sides of the handgrip body, wherein each of the first pair of openings and the second pair of openings are aligned linearly when the bottom end of the adapter body is positioned through the opening on the top end of the handgrip body.

5. The assembly of claim 4, wherein the latching mechanism includes a resilient member having a pair of buttons.

6. The assembly of claim 5, wherein the pair of buttons are positioned within and extend through the first pair of openings.

7. The assembly of claim 6, wherein the pair of buttons are configured to selectively engage the second pair of openings when the portion of the adapter body is positioned within the handgrip body.

8. The assembly of claim 1, wherein the bottom end of the adapter includes a shape and a size that is complementary to a shape and a size of the opening along the top end of the handgrip body.

9. The assembly of claim 8, further comprising:

a first pair of openings that are positioned along the pair of sides of the adapter body; and a second pair of openings that are positioned along the pair of sides of the handgrip body, wherein each of the first pair of openings and the second pair of openings are aligned linearly when the bottom end of the adapter body is positioned through the opening on the top end of the handgrip body.

10. The assembly of claim 9, wherein the latching mechanism includes a resilient member having a pair of buttons.

11. The assembly of claim 9, wherein the pair of buttons are positioned within and extend through the first pair of openings.

12. The assembly of claim 11, wherein the pair of buttons are configured to selectively engage the second pair of openings when the bottom end of the adapter body is positioned within the handgrip body.

13. The assembly of claim 11, wherein each of the pair of buttons are configured to receive a pushing force to disengage from the second pair of openings.

14. A firearm receiver, comprising:

a receiver body;

a trigger assembly;

an adapter body having a top end, a bottom end, a front end, a back end, and a pair of sides;

an elongated handgrip body having a top end, an opening along the top end, a bottom end, a front end, a back end, a pair of sides, and a hollow interior space; and a latching mechanism that is positioned within the adapter body, wherein the top end of the adapter body is in communication with a bottom end of the receiver at a location adjacent to the trigger assembly, wherein the bottom end of the adapter body is configured to be positioned within the opening on the top end of the handgrip body, and wherein the latching mechanism is configured to removably secure the handgrip body and the adapter body together.

15. The firearm receiver of claim 14, wherein the bottom end of the adapter includes a shape and a size that is complementary to a shape and a size of the opening along the top end of the handgrip body.

16. The firearm receiver of claim 15, further comprising:

a first pair of openings that are positioned along the pair of sides of the adapter body; and a second pair of openings that are positioned along the pair of sides of the handgrip body, wherein each of the first pair of openings and the second pair of openings are aligned linearly when the bottom end of the adapter body is positioned within the handgrip body.

17. The firearm receiver of claim 16, wherein the latching mechanism includes a resilient member having a pair of buttons.

18. The firearm receiver of claim 17, wherein the pair of buttons are positioned within and extend through the first pair of openings.

19. The firearm receiver of claim 18, wherein the pair of buttons are configured to selectively engage the second pair of openings when the bottom end of the adapter body is positioned within the handgrip body.

20. The firearm receiver of claim 19, wherein each of the pair of buttons are configured to receive a pushing force to disengage from the second pair of openings.

* * * * *